US007757528B2

(12) United States Patent
Yamakawa et al.

(10) Patent No.: US 7,757,528 B2
(45) Date of Patent: Jul. 20, 2010

(54) METHOD OF MANUFACTURING SEAMLESS PIPE OR TUBE

(75) Inventors: Tomio Yamakawa, Osaka (JP); Kazuhiro Shimoda, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/285,033

(22) Filed: Sep. 29, 2008

(65) Prior Publication Data

US 2009/0038359 A1 Feb. 12, 2009

Related U.S. Application Data

(63) Continuation of application No. PCT/JP2007/057085, filed on Mar. 30, 2007.

(30) Foreign Application Priority Data

Mar. 31, 2006 (JP) ..... 2006-098634

(51) Int. Cl.
*B21B 19/04* (2006.01)
*B21B 17/10* (2006.01)

(52) U.S. Cl. ..... 72/97; 72/208

(58) Field of Classification Search ..... 72/97, 72/208, 209
See application file for complete search history.

(56) References Cited

U.S. PATENT DOCUMENTS 1,923,700 A * 8/1933 Becker ..... 72/97

FOREIGN PATENT DOCUMENTS

| | | |
|---|---|---|
| JP | 59-50906 | 3/1984 |
| JP | 2000-246311 | 9/2000 |
| JP | 2001-58207 | 3/2001 |
| JP | 2001-162306 | 6/2001 |
| JP | 3503552 | 12/2003 |

* cited by examiner

*Primary Examiner*—Dana Ross
*Assistant Examiner*—Debra M Sullivan
(74) *Attorney, Agent, or Firm*—Clark & Brody

(57) ABSTRACT

A billet is provided on a pass line between a pusher and a plug, and the billet is advanced and caught between a plurality of inclined rolls. At least between when said caught billet contacts said plug and when the piercing and rolling reaches a steady state, the advancing speed of the billet is not less than the advancing speed of the billet when the piercing and rolling is carried out without pushing the billet forward by the pusher in the steady state. By this manufacturing method, inner surface defects at a tip end of a hollow shell can be restrained.

4 Claims, 6 Drawing Sheets

METHOD OF MANUFACTURING SEAMLESS PIPE OR TUBE

This application is a continuation of International Patent Application No. PCT/JP2007/057085, filed Mar. 30, 2007. This PCT application was not in English as published under PCT Article 21(2).

TECHNICAL FIELD

The present invention relates to a method of manufacturing a seamless pipe or tube, and more specifically, to a method of manufacturing a seamless pipe or tube by piercing and rolling a billet using a piercing mill.

BACKGROUND ART

The seamless pipe or tube in general is produced by piercing and rolling a solid round billet using a piercing mill. The piercing mill includes a pusher provided along a pass line on the inlet side, a plug provided along the pass line on the outlet side, and a plurality of inclined rolls arranged opposed to one another with the plug therebetween.

A billet heated in a heating furnace is arranged on the pass line. Then, the billet has its rear end pushed by the pusher and is transported toward between the plurality of inclined rolls along the pass line. In other words, the pusher serves to transport the billet. When the billet is caught between the plurality of inclined rolls, the pusher stops its operation. The billet engaged between the plurality of inclined rolls is pierced and rolled as it helically advances, and formed into a hollow shell.

In the above-described piercing and rolling, leaf-, fin-, or lap-shaped defects (hereinafter referred to as "inner surface defects") are generated at the inner surface of the hollow shell after the piercing and rolling because of the rotary forging effect and additional shear deformation. Therefore, measures to reduce the inner surface defects have been studied.

Methods of restraining such inner surface defects during the piercing and rolling are disclosed by JP 2000-246311 A (hereinafter as "Patent Document 1"), JP 2001-162306 A (hereinafter as "Patent Document 2") and Japanese Patent No. 3503552 (hereinafter as Patent Document 3"). In the disclosure of these documents, the piercing and rolling may be carried out with a smaller rolling reduction than in the conventional case in order to restrain inner surface defects. If the rolling reduction is reduced during the piercing and rolling, the billet is less stably caught between the inclined rolls but such defective entry is prevented when the pusher pushes the billet from behind according to the disclosure. In short, according to these documents, the pusher is used in order to improve the defective entry of the billet that could be caused because of the reduced rolling reduction.

More specifically, as shown in FIG. 7 (that corresponds to FIG. 4 in Patent Document 1 and FIG. 4(*c*) in Patent Document 2), when a billet contacts inclined rolls and a plug at time t1, the roll load represented by the solid line in the figure (the load of the inclined rolls acting in the rolling direction) and the load of the plug represented by the broken line in the figure (the thrust load of the plug) increase. However, since the billet entry is unstable, the roll load and the plug load are lowered at time t1 to t3. More specifically, defective entry is caused in the period and the billet is in a slipped state. Since the billet entry is unstable, the billet is pushed from behind by the pusher at time t3. In this way, the billet is engaged between the inclined rolls, and the roll load and the plug load increase. At time t6 when the entry is stabilized, the pusher stops pushing the billet. The billet has already been engaged between the inclined rolls in a stable manner, so that the roll load and the plug load gradually increase thereafter, and at time t7 and t8 and after, the roll load and the plug load become substantially constant, in other words, the piercing and rolling reaches a steady state. According to these documents, the moving speed of the pusher is less than the speed of the billet in the rolling direction when the piercing and rolling is in the steady state. The pusher is used to improve the defective entry and it is only necessary to push the billet with the pusher when the advancing efficiency of the billet is low due to the defective entry, in other words, when the advancing speed of the billet is reduced or kept low due to the defective entry.

According to the piercing and rolling method, as shown in FIG. 8 (that corresponds to FIG. 5 in Patent Document 1), there is almost no increase in the speed of the billet in the rolling direction during the period from the start of entry to time t3 when the pusher starts to push, and the speed gradually increases after the pusher starts to push the billet at time t3. When the billet is pushed by the pusher and stably engaged, the billet departs the pusher and its speed in the rolling direction increases. After the piercing and rolling reaches a steady state, the speed in the rolling direction becomes constant.

However, if a billet is formed into a hollow shell by piercing and rolling by the disclosed methods, a greater number of inner surface defects are generated at the tip end part of the hollow shell than at the central part of the hollow shell. The tip end part with the inner surface defects may be cut off using a cutter and a reduced number of inner surface defects would remain in the seamless pipe, while the yield is lowered for the removed part. Therefore, it is preferable to reduce generation of inner surface defects at the tip end part itself rather than simply cutting off the tip end part with the inner surface defects.

SUMMARY OF THE INVENTION

It is an object of the invention to provide a method of manufacturing a seamless pipe or tube that allows inner surface defects at the tip end of a pierced and rolled hollow shell to be reduced.

The inventors measured the advancing speed of the billet (the speed in the rolling direction) during piercing and rolling and the rotation speed of the billet in the circumferential direction during the piercing and rolling in order to examine the cause for a larger number of inner surface defects generated at the tip end part than at the central part.

A S45C solid round billet having an outer diameter of 70 mm was prepared as a test material. The prepared billet was heated to 1200° C. and then the heated billet was pierced and rolled by a piercing mill. More specifically, the billet was pierced and rolled under the conditions in which the inclination angle of the inclined rolls was 10°, the roll interval between the gorge parts of the inclined rolls was 61 mm, and the plug advanced amount representing the axial distance from the gorge parts of the inclined rolls to the plug tip end was 38 mm. In this way, the billet was formed into a hollow shell having an outer diameter of 75 mm and a thickness of 6 mm. In this case, the billet was not pushed using the pusher.

The advancing speed of the billet during the piercing and rolling was measured by the following method. A scale plate was provided along the pass line on the inlet side of the piercing mill. During the piercing and rolling, the rear end of the billet and the scale plate were taken using a video camera so that the moving distance of the rear end of the billet per unit time was obtained according to the scale plate. The advancing speed of the billet was calculated based on the obtained image data.

The rotation speed of the billet during the piercing and rolling was measured by the following method. A pin to serve as a mark was attached near the outer circumference of the rear end surface of the billet and the movement of the pin at the rear end surface of the billet in the process of piercing and rolling was taken using a video camera. The amount of movement of the pin in the circumferential direction per unit time was obtained based on the obtained image data and the rotation speed of the billet was calculated.

The measurement result of the advancing speed of the billet is given in FIG. 1. The abscissa represents the moving distance (mm) of the billet from the position where the billet contacts the inclined rolls (entering position). The ordinate represents the advancing speed ratio of the billet. The advancing speed ratio is the ratio of the billet advancing speed at each of the moving distances to the average billet advancing speed when the piercing and rolling is in the steady state. As shown in FIG. 1, the advancing speed of the billet abruptly dropped as the billet contacted the inclined rolls (LE0) and was then engaged therebetween. The billet advancing speed was minimized at distance LE1 where the tip end of the billet contacted the plug tip end and started to be pierced. Thereafter, as the billet was engaged stably (or the billet advanced without slipping) and gradually pierced, the advancing speed gradually increased. Then, the advancing speed became substantially constant at distance LE2 where the piercing and rolling attained a steady state. More specifically, similarly to FIG. 8, the advancing speed of the billet after the billet was contacted the inclined rolls and started to be pierced by the plug until the steady state was attained was lower than the advancing speed in the steady state.

The rotation speed of the billet was substantially the same after the billet contacted the inclined rolls until the piercing and rolling attained a steady state and then ended.

From the foregoing examination results, the inventors made the following findings. During the period after the billet is caught between the inclined rolls and starts to be pierced by the plug until the piercing and rolling reaches a steady state, in other words, between distance LE1 and distance LE2 in FIG. 1, the advancing speed of the billet is lower than the advancing speed in the steady state (after distance LE2 in FIG. 1). Meanwhile, the billet rotation speed is substantially constant during the piercing and rolling. Therefore, the number of rotary forging of the billet per unit moving amount in the advancing direction is larger in the LE1-LE2 region than in the region after LE2 (in the steady state). The billet tip end is pierced in the LE1-LE2 region, so that the billet tip end part is more strongly affected by the rotary forging effect than the central and rear end parts of the billet that are pierced in the steady state. As a result, a greater number of inner surface defects are generated at the tip end part of the hollow shell that corresponds to the tip end of the pierced billet.

Based on the above-described findings, the inventors considered that the advancing speed of the billet until a steady state is obtained should be greater than in the conventional case. If the advancing speed is increased, the moving amount of the billet per one rotation increases, which reduces the number of rotary forging. Consequently, the rotary forging effect is restrained, so that inner surface defects can be reduced. Furthermore, they also considered that if the advancing speed of the billet before piercing and rolling reaches a steady state is not less than the advancing speed in the steady state, the amount of inner surface defects at the tip end of the hollow shell can be reduced to a level equal to or less than the level at the central and rear end parts of the hollow shell.

Based on the above-described ideas, the inventors have completed the following invention.

A method of manufacturing a seamless pipe or tube according to the invention pierces and rolls a solid billet using a piercing mill including a pusher provided on the inlet side along a pass line, a plug provided on the outlet side along the pass line, and a plurality of inclined rolls provided opposed to one another with the plug therebetween. The method of manufacturing a seamless pipe or tube according to the invention includes the steps of placing the billet on the pass line between the pusher and the plug, advancing the billet to be caught between the plurality of inclined rolls, and pushing the billet forward by the pusher so that at least between when the caught billet contacts the plug and when the piercing and rolling reaches a steady state, the advancing speed of the billet is at least equal to the advancing speed of the billet when piercing and rolling is carried out without pushing the billet forward by the pusher in the steady state.

Here, the steady state refers to the state in the period after the tip end of a pierced and rolled billet comes out from between the inclined rolls until the rear end of the billet contacts the inclined rolls.

In the method of manufacturing a seamless pipe according to the invention, the billet is pushed forward at least during the period between when the billet is caught between the inclined rolls and contacts the plug and when the piercing and rolling reaches a steady state (hereinafter referred to as a non-steady state). More specifically, the pusher is pushed forward at least until the piercing and rolling reaches a steady state after the billet is stably caught between the inclined rolls. At the time, the advancing speed of the billet in the non-steady state is not less than the advancing speed of the billet in the steady state when the piercing and rolling is carried out without pushing the billet forward by the pusher (hereinafter as piercing without using the pusher). Therefore, the effect of rotary forging on the tip end of the hollow shell is equal to or lower than the rotary forging effect on the center and rear end of the hollow shell. Therefore, inner surface defects at the tip end of the hollow shell can be restrained.

Here, the advancing speed of the billet in the non-steady state is for example the average advancing speed of the billet in the non-steady state. The advancing speed in the steady state is for example the average advancing speed of the billet in the steady state in the piercing without using the pusher.

Preferably, in the step of pushing forward, the billet is pushed forward by the pusher so that thrust load acting on the plug at least between when the caught billet contacts the plug and when the piercing and rolling reaches a steady state is at least equal to thrust load acting on the plug when piercing and rolling is carried out without pushing the billet forward by the pusher in the steady state.

Here, the thrust load of the plug refers to the load acting on the plug in the axial direction (so-called plug load).

In this way, the advancing speed of the billet in the non-steady state is not less than the advancing speed of the billet in the steady state in the piercing without using the pusher. Therefore, the number of rotary forging in the non-steady state can be smaller than that of the conventional case. Consequently, inner surface defects at the tip end of the hollow shell can be reduced.

Preferably, the method of manufacturing a seamless pipe further includes the step of setting the position of the inclined rolls before the piercing and rolling so that Expressions (1) and (2) are satisfied.

$$Dg/d \leqq 4.5 \quad (1)$$

$$-0.01053EL+0.8768 \leqq DFT \leqq -0.01765EL+0.9717 \quad (2)$$

where Dg is the roll diameter (mm) of the gorge part of the inclined roll, d is the outer diameter (mm) of the billet, DFT is the gorge draft ratio, EL is the piercing and rolling ratio in Expression (2), and the ratios are defined by Expressions (3) and (4):

$$DFT=Rg/d \quad (3)$$

$$EL=L1/L0 \quad (4)$$

where Rg is the roll interval (mm) that is minimized at the gorge part, L0 is the length (mm) of the billet, and L1 is the length (mm) of the hollow shell produced by piercing and rolling.

In this way, Expression (2) is satisfied, so that the advancing efficiency of the billet in the steady state can be restrained from being lowered. Therefore, the billet can be prevented from slipping and stopping during piercing and rolling and the billet rear end can be prevented from being clogged between the inclined rolls, or a so-called tailing-off failure can be prevented. Furthermore, since the slipping in the steady state can be prevented, the rotary forging effect caused by the slipping can be reduced, so that inner surface defects in steady state can be restrained.

Preferably, the method of manufacturing a seamless pipe according to the invention includes the step of stopping pushing the billet forward by the pusher when the piercing and rolling reaches a steady state.

In this way, once the attainment of a steady state is determined, the pusher operation is stopped, so that the plug and the billet in the process of piercing and rolling can be prevented from being continuously provided with excessive load by the pusher.

Preferably, the piercing mill further includes a detector provided on the outlet side to detect whether the tip end of the hollow shell passes between the rear ends of the inclined rolls. In the stopping step, the pushing forward of the billet by the pusher is stopped when the detector detects the tip end of the hollow shell passing between the rear ends of the inclined rolls.

As described in conjunction with FIG. 7, in the conventional piercing and rolling, whether or not the piercing and rolling reaches a steady state can be determined by monitoring the thrust load of the plug in the process of piercing and rolling. This is because the thrust load of the plug gradually increases in the non-steady state and becomes substantially constant in the steady state. Therefore, if the thrust load of the plug in the steady state is measured in advance, it can be determined whether a steady state is attained based on the measurement value.

However, according to the invention, the steady state cannot be determined according to the above-described method. This is because the thrust load of the plug in the non-steady state is not less than the thrust load in the steady state during the piercing without using the pusher.

Therefore, according to the invention, it is determined based on whether the tip end of the material in the process of piercing and rolling has passed the rear ends of the inclined rolls. If the tip end of a material has passed the rear ends of the inclined rolls, the piercing and rolling has already attained a steady state. After the attainment of the steady state is determined, the pusher operation is stopped, so that the plug and the billet in the process of piercing and rolling can be prevented from being continuously provided with excessive load by the pusher.

BEST MODE FOR CARRYING OUT THE INVENTION

Figure 1:
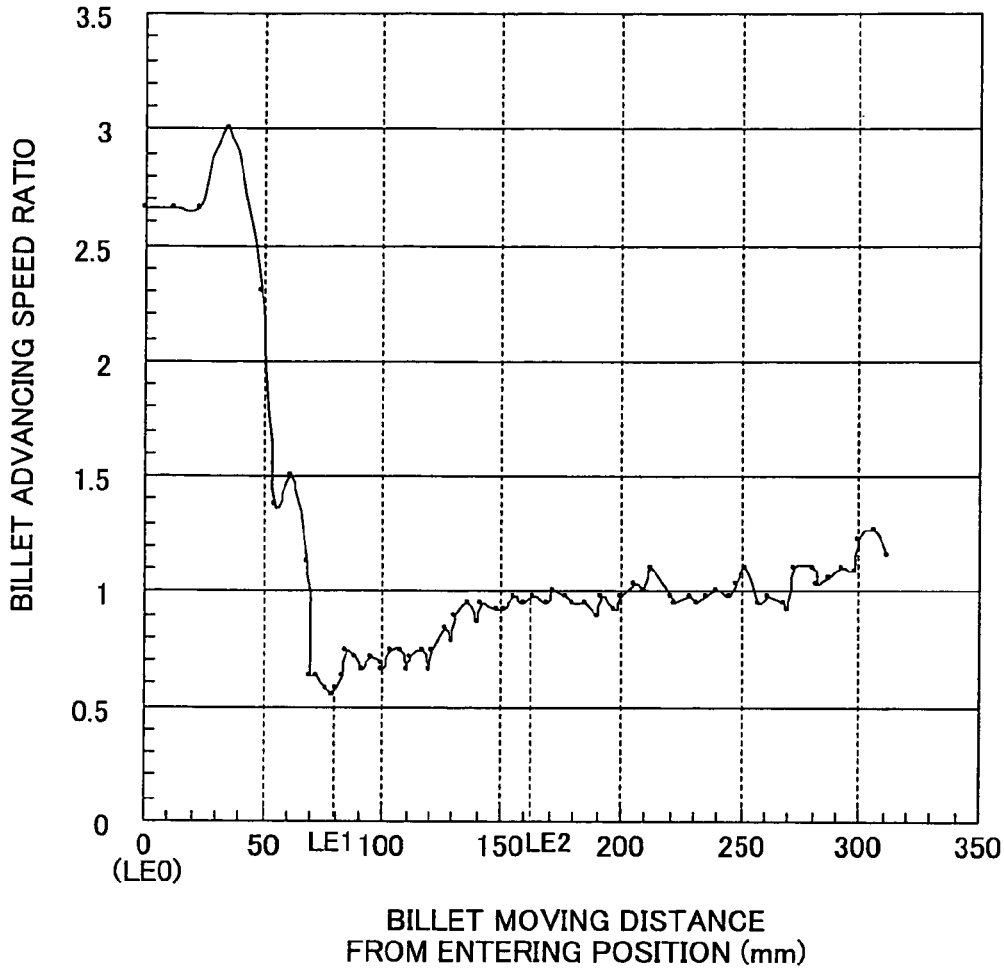
FIG. 1 is a graph showing measurement results of the advancing speed of a billet in piercing and rolling without pushing the billet with the pusher.

Now, embodiments of the invention will be described in conjunction with the accompanying drawings, in which the same or corresponding portions are denoted by the same reference characters and their description is not repeated.

Piercing Mill

Figure 2:
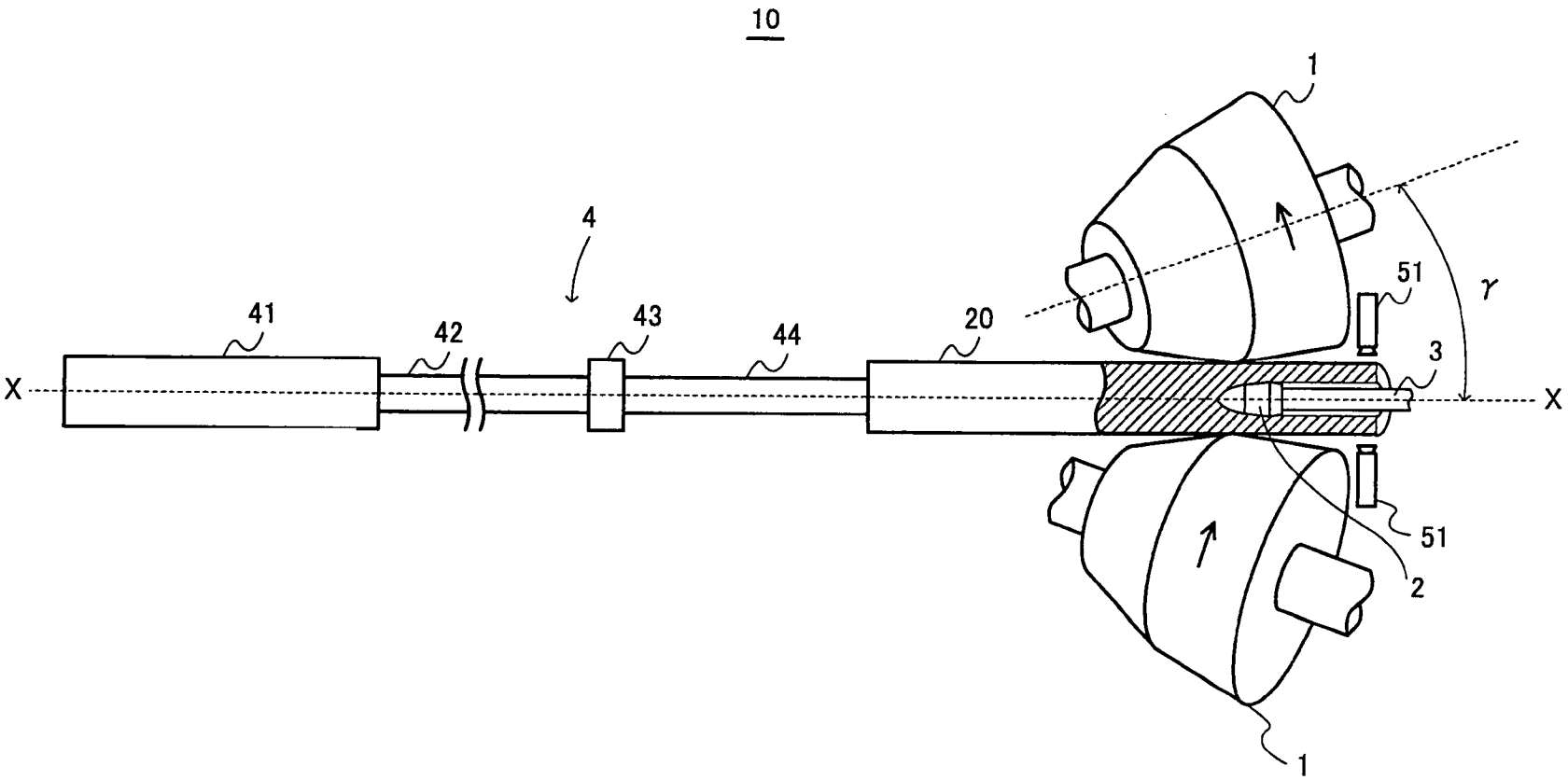
FIG. 2 is a top view of the structure of a piercing mill according to an embodiment of the invention.
Figure 3:
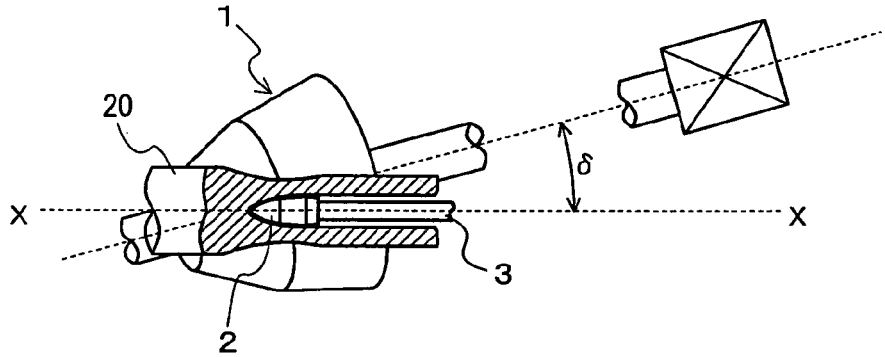
FIG. 3 is a side view of the structure of the piercing mill in FIG. 2.

With reference to FIGS. 2 and 3, a piercing mill 10 includes two cone-type inclined rolls (hereinafter simply as "inclined rolls") 1, a plug 2, a mandrel 3, a pusher 4, and an HMD (Hot Metal Detector) 51 provided on the outlet side of the piercing mill 10.

The two inclined rolls 1 are provided opposed to each other with the pass line X-X therebetween. Each of the inclined rolls 1 has an inclination angle δ and crossed axes angle γ with respect to the pass line X-X. The plug 2 is between the two inclined rolls 1 and provided on the pass line X-X. The mandrel 3 is provided along the pass line X-X on the outlet side of the piercing mill 10 and its tip end is connected to the rear end of the plug 2.

The pusher 4 is provided in the front of the inlet side of the piercing mill 10 and along the pass line X-X. The pusher 4 includes a cylinder main body 41, a cylinder shaft 42, a connection member 43, and a billet pushing rod 44. The billet pushing rod 44 is coupled with the cylinder shaft 42 by the connection member 43 so that it can rotate in the circumferential direction. The cylinder main body 41 is a hydraulic or electromotive type device and advances/withdraws the cylinder shaft 42. The pusher 4 pushes a billet 20 from behind as the pusher has the tip end surface of the billet pushing rod 44 abutted against the rear end surface of the billet 20 and advances the cylinder shaft 42 and the billet pushing rod 44 by the cylinder main body 41.

The pusher 4 pushes the billet 20 forward in the rolling direction and has the billet caught between the inclined rolls 1. The pusher 4 further continues to push the billet 20 at least after the caught billet 20 contacts the tip end of the plug 2 until the piercing and rolling reaches a steady state, in other words, during the period in a non-steady state.

The HMD 51 as a detector is provided in the vicinity of the rear ends of the inclined rolls 1 on the outlet side of the piercing mill 10. The HMD 51 detects whether the tip end of a hollow shell after piercing and rolling has passed between the inclined rolls 1. If it is determined based on the detection result by the HMD 51 that the tip end of the hollow shell has passed between the inclined rolls 1, the pusher 4 stops pushing the billet 20.

Method of Manufacturing Seamless Pipe or Tube

Now, a method of manufacturing a seamless pipe or tube using the above-described piercing mill 10 will be described.

First Process

To start with, inclined rolls 1 having a gorge part with a roll diameter that satisfies the following Expression (1) is prepared.

$$Dg/d \geqq 4.5 \quad (1)$$

where Dg is the roll diameter (mm) of the gorge part and d is the outer diameter (mm) of a billet 20 to be pierced and rolled.

If Dg/d is less than 4.5, the entering angle in the rotation direction (billet circumferential direction) when the billet 20 is engaged between the inclined rolls 1 is large, and therefore slipping is more likely to be caused. Here, the entering angle refers to the angle formed by a segment connecting the point on the inclined roll surface that starts to contact the billet 20 and a point on the central axis of the inclined roll and a segment connecting a point on the pass line X-X and a point on the central axis of the inclined roll in a cross section normal to the pass line X-X including the point on the inclined roll 1 that contacts the billet first. In order to reduce slipping caused by increase in the entering angle, the inclined rolls 1 that satisfy Expression (1) are prepared and the prepared inclined rolls 1 are provided at the piercing mill 10.

Second Process

Figure 4:
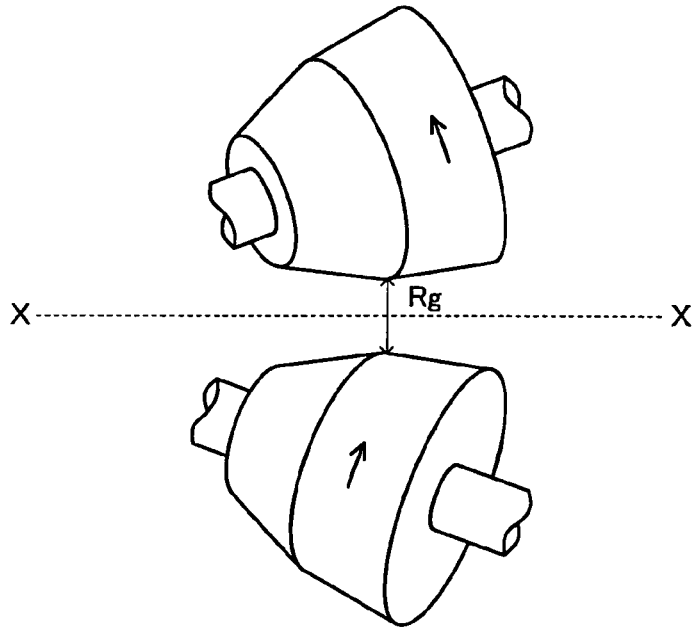
FIG. 4 is a view for use in illustrating the inclined roll interval in the piercing mill in FIG. 2.

Then, the position of the two inclined rolls 1 is set. With reference to FIG. 4, when the roll interval that is minimized at the gorge parts of the inclined rolls 1 is Rg, the inclined rolls 1 are positioned so that the following Expression (2) is satisfied.

$$-0.01053EL+0.8768 \leqq DFT \leqq -0.01765EL+0.9717 \quad (2)$$

In Expression (2), DFT represents the gorge draft ratio, EL represents the piercing and rolling ratio, and they are defined by the following Expressions (3) and (4), respectively.

$$DFT=Rg/d \quad (3)$$

$$EL=L1/L0 \quad (4)$$

where L0 is the length (mm) of the billet 20 yet to be pierced and L1 is the length (mm) of a hollow shell produced by piercing and rolling the billet 20. If the outer diameter d (mm) and the length L0 (mm) of the billet 20 and the outer diameter and the thickness of the hollow shell after piercing are determined, the length L1 (mm) of the hollow shell can be produced by calculation.

As Expression (2) is satisfied, the advancing efficiency of the billet 20 can be restrained from being lowered between the attainment of a steady state of the piercing and rolling and the end of the piercing and rolling. Therefore, the rotary forging effect can be prevented in the steady state, and inner surface defects can be restrained in the steady state. In short, inner surface defects at the center and rear end of the billet 20 can be reduced. Now, this will be described in detail.

As the gorge draft ratio DFT decreases, the roll interval Rg decreases. Therefore, the billet 20 in the process of piercing has a cross sectional shape with increased ellipticity, and the entering angle in the rotation direction of the inclined rolls 1 increases. The increase in the entering angle causes the billet 20 to slip.

On the other hand, as the gorge draft ratio DFT increases, the roll interval Rg increases, and the contact area between the inclined rolls 1 and the billet 20 decreases, which gives rise to slipping. Therefore, the gorge draft ratio must be set to an appropriate value in consideration of the entering angle and the contact area.

As the piercing and rolling ratio EL increases, the contact area between the billet being pierced and rolled and the plug 2 increases. The increase in the contact area increases the reaction received from the plug 2 and slipping is more likely to happen. This is because in order to increase the piercing and rolling ratio EL, the outer diameter of the plug 2 must be increased and the thickness of the hollow shell must be reduced.

As in the foregoing, during the period between the steady state and the end of the piercing and rolling, the gorge draft ratio DFT and the piercing and rolling ratio EL are related to slipping of the billet 20. Therefore, during the period between the attainment of the steady state and the end of the piercing and rolling, the gorge draft ratio DFT must be set in consideration of the piercing and rolling ratio EL in order to prevent the advancing efficiency of the billet 20 from being dropped.

If DFT satisfies Expression (2), the advancing efficiency of the billet 20 can be prevented from being reduced, and inner surface defects can be reduced during the period between the start of the steady state and the end of the piercing and rolling. If DFT is outside the range defined by Expression (2), the billet 20 is more likely to slip, which reduces the advancing efficiency. Therefore, the billet 20 in the process of piercing and rolling could slip or suffer from a tailing-off failure. The slipping could cause inner surface defects to be more easily generated.

Third Process

After the positioning of the inclined rolls 1 is adjusted, the billet 20 is transported and provided between the pusher 4 and the plug 2.

Then, the provided billet 20 is pierced and rolled. The pusher 4 pushes forward the billet 20 to between the inclined rolls 1 and has the billet 20 caught between the two inclined rolls 1. More specifically, the pusher 4 has the tip end surface of the billet pushing rod 44 abutted against the rear end surface of the billet 20, so that the driving force of the cylinder main body 41 advances the billet pushing rod 44 toward the inlet side of the piercing mill 10.

Fourth Process

The billet 20 is caught between the inclined rolls 1 and the piercing and rolling is started. Here, between the contact of the tip end of the engaged billet 20 with the tip end of the plug 2 and the attainment of a steady state, in other words, in a non-steady state, the pusher 4 pushes the billet 20 forward so that the advancing speed of the billet 20 in the non-steady state is not less than the advancing speed of the billet in the steady state during piercing without using the pusher. Here, the advancing speed in the non-steady state is the average advancing speed of the billet 20 in the non-steady state, and the advancing speed of the billet during the piercing without using the pusher is the average advancing speed of the billet of the same steel kind having substantially the same outer diameter as the billet 20 in the steady state.

Preferably, the pusher 4 pushes the billet 20 forward with such pushing force that the thrust load acting upon the plug 2 in the non-steady state is not less than the thrust load acting on the plug 2 in the steady state without using the pusher.

In this way, the billet 20 can be prevented from slipping. The advancing speed of the billet 20 in the non-steady state is higher than the advancing speed in a conventional non-steady state, and therefore the rotary forging effect in the non-steady state is reduced from the conventional one. Therefore, inner surface defects at the tip end part of the hollow shell can be reduced.

The advancing speed of the billet 20 in the non-steady state is not less than its advancing speed in the steady state, and therefore the rotary forging effect in the non-steady state can be reduced to about the level of the rotary forging effect in the steady state or less. Therefore, inner surface defects at the tip end of the hollow shell can be reduced.

The thrust load of the plug in the steady state may be measured in advance or may be obtained by calculation based on various conditions such as the rotation speed of the inclined rolls and the shape of the billet. The pushing force (pusher pressure) acting on the billet by the pusher 4 and the advancing speed of the billet pushing rod 44 are set based on the thrust load in the steady state measured or obtained by calculation.

The billet advancing speed in the steady state during piercing without using the plug may be measured in advance or obtained by calculation based on various conditions such as the rotation speed of the inclined rolls and the shape of the billet. When the billet 20 is pushed forward by the pusher 4 so that the advancing speed of the billet 20 in the non-steady state is not less than the advancing speed in the steady state, the pusher pressure and the advancing speed of the billet pushing rod 44 are set based on the advancing speed of the billet 20 in the steady state that has been measured in advance or calculated.

Fifth Process

When the HMD 51 provided behind the inclined rolls 1 detects the tip end of the hollow shell passing the rear ends of the inclined rolls 1 after the piercing and rolling transits to the steady state, the pusher 4 finishes pushing the billet 20 forward. When the tip end of the hollow shell passes the rear ends of the inclined rolls, the piercing and rolling has moved to the steady state, and therefore the billet is pierced and rolled at a constant speed if the operation of the pusher 4 stops.

In this way, by the method of producing a seamless pipe according to the invention, during the period between the contact of the caught billet 20 with the tip end of the plug 2 and the attainment of the steady state of the piercing and rolling (the non-steady state period), the pusher 4 pushes the billet 20 forward. Therefore, the slipping of the billet 20 in the non-steady state can be restrained, so that the rotary forging effect can be restrained. Consequently, inner surface defects at the tip end of the hollow shell can be reduced.

Figure 5:
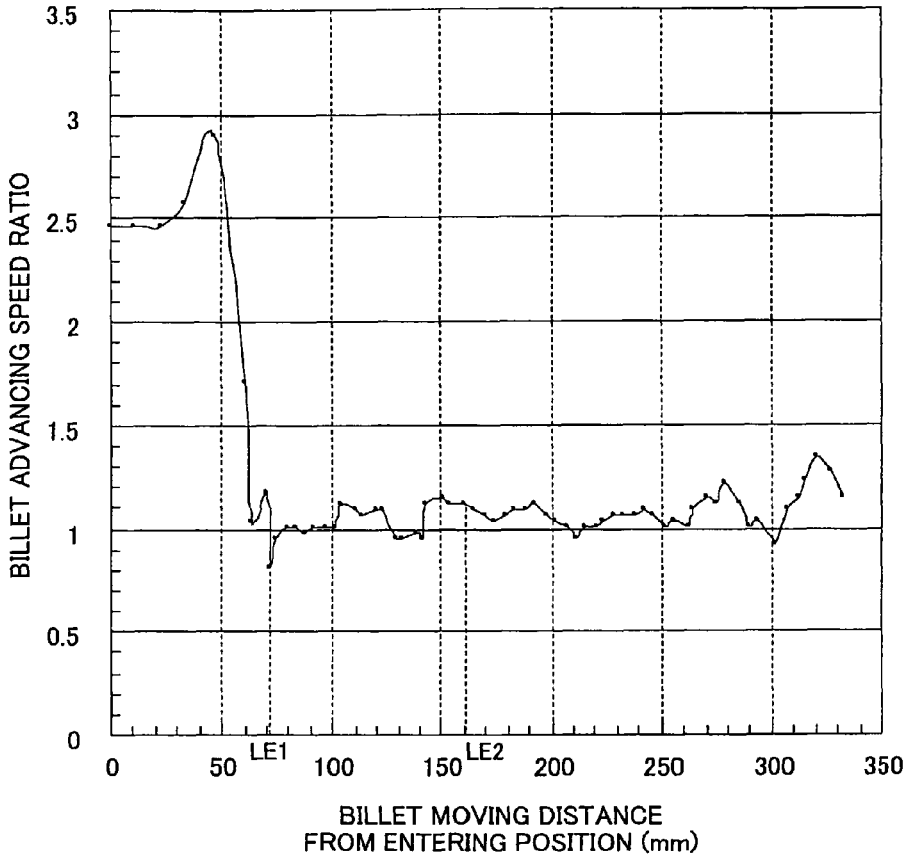
FIG. 5 is a graph showing the billet advancing speed in the piercing and rolling in a method of manufacturing a seamless pipe according to the invention.

FIG. 5 shows the transition of the advancing speed of the billet 20 pushed forward by the pusher 4 so that thrust load acting on the plug 2 in the non-steady state was not less than thrust load acting on the plug 2 in the steady state during piercing without using the pusher as an example of the invention. In the examination to obtain the result in FIG. 5, the pusher continued to push at distance LE2 and after. The other conditions were the same as those in FIG. 1.

The billet advancing speed ratio of the billet on the ordinate in FIG. 5 is the ratio of the average advancing speed in the steady state during piercing without using the pusher relative to the billet advancing speed at each of the moving distances. In almost the entire section between the distance LE1 and distance LE2 in FIG. 5, the billet advancing speed is not less than the advancing speed at distance LE2 or after in FIG. 1, in other words, is not less than the advancing speed in the steady state during piercing without using the pusher, while the average advancing speed of the billet in the non-steady state in FIG. 5 is not less than the average advancing speed of the billet in the steady state during piercing without using the pusher in FIG. 1. More specifically, the billet advancing speed in the non-steady state in FIG. 5 is higher than that in FIG. 1. In this way, according to the invention, the advancing speed in the non-steady state can be higher than the conventional case, and therefore the rotary forging effect in the non-steady state can be reduced, so that inner surface defects at the tip end of the hollow shell can be reduced.

Furthermore, as Expressions (1) and (2) are satisfied, the advancing efficiency of the billet 20 in the steady state can be restrained from being lowered, so that the slipping in the steady state can be prevented. Since the slipping can be prevented, inner surface defects can be reduced at the center and rear end part of the hollow shell being pierced and rolled during the period after the piercing and rolling reaches a steady state region until the piercing and rolling ends.

Figure 7:
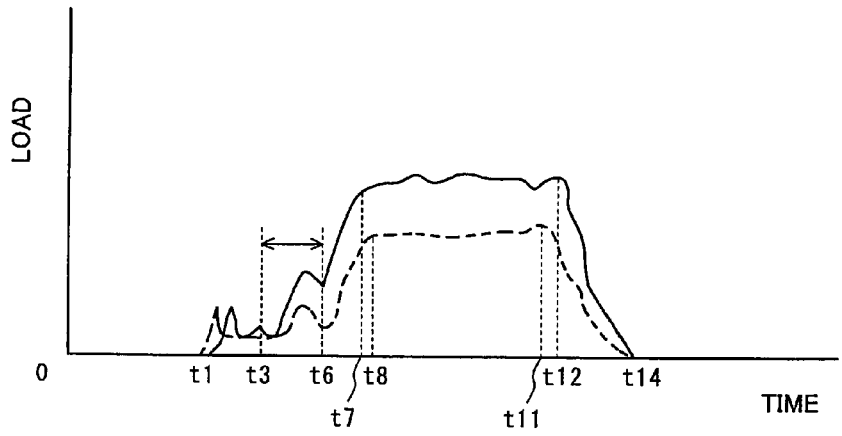
FIG. 7 PRIOR ART
FIG. 7 is a graph showing the transition of a plug load in conventional piercing and rolling.
Figure 8:
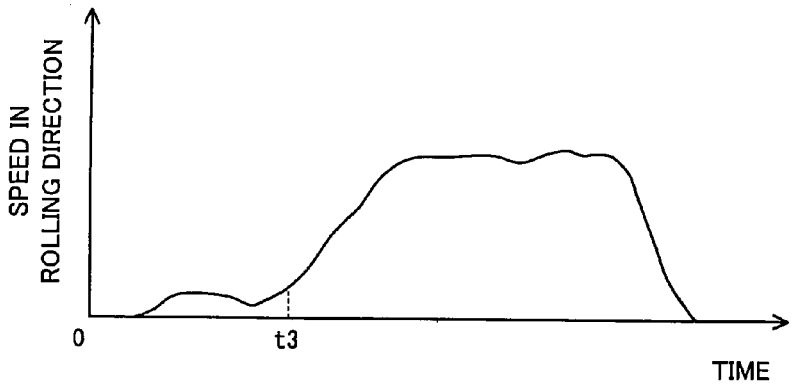
FIG. 8 PRIOR ART
FIG. 8 is a graph showing the transition of the advancing speed of a billet in the conventional piercing and rolling.

In addition, if the pusher 4 stops pushing the billet 20 after the process proceeds to the steady state, the plug 2 or the inclined rolls 1 can be prevented from being continuously provided with excessive load. In general, if the thrust load acting on the plug 2 during piercing and rolling is monitored, it can be determined whether the piercing and rolling reaches a steady state. This is because the thrust load of the plug 2 gradually increases in the non-steady state and becomes substantially constant in the steady state as shown in FIG. 7. Therefore, in conventional piercing and rolling, if the thrust load of the plug 2 in the steady state is measured in advance, it can be determined whether a steady state is attained based on the measurement value. However, according to the invention, the steady state cannot be determined according to the method. This is because the thrust load of the plug 2 in the non-steady state is not less than the thrust load of the steady state.

Therefore, according to the invention, the HMD 51 as a detector is provided in the vicinity of the rear ends of the inclined rolls 1 on the outlet side of the piercing mill 10. The HMD 51 determines whether the tip end of the hollow shell pierced and rolled has passed the rear ends of the inclined rolls 1. This is because if the tip end of the hollow shell passes the inclined rolls 1, the piercing and rolling is already in a steady state.

Note that according to the embodiment, the detector is an HMD, but the detector may be any of other devices such as a photo sensor and a laser sensor. It is only necessary that the detector is capable of detecting the tip end of a hollow shell passing the rear ends of the inclined rolls 1.

The embodiment includes the first to fifth processes, while it is only necessary to carry out the third and fourth processes in order to reduce inner surface defects at the tip end of the hollow shell. In the fifth process, the operation of the pusher 4 is stopped in the steady state, while as shown in FIG. 5, the billet 20 may continue to be pushed by the pusher in the steady state. In this way, the rotary forging effect in the non-steady state and steady state can be restrained.

The billet 20 may be pushed forward by the pusher 4 before the billet 20 is caught between the inclined rolls 1 or the billet 20 may be pushed forward by the pusher 4 after the billet 20 is caught between the inclined rolls. In short, if the billet 20 is pushed forward by the pusher 4 at least during a period including the non-steady state, inner surface defects at the tip end of the hollow shell can be reduced.

The pusher 4 is provided on a platform (not shown) whose height is adjustable and the position of the pusher 4 (in the vertical and horizontal directions) may be adjusted so that the central axis of the billet pushing rod 44 approximately matches the central axis of the billet. In this way, large pusher pressure can be set, so that the billet can be prevented from being bent if the pushing force upon the billet increases.

The piercing mill 10 may further include a pressing roller on the inlet side that binds the billet so that the central axis of the billet is not shifted from the pass line X-X.

According to the embodiment of the invention, the inclined rolls 1 are cone-type rolls while they may be barrel type rolls.

Note that when a billet with porosity remaining along the central axis such as a billet of steel with low deformability or a billet produced by continuous casting (i.e., so-called round CC billet) is pierced and rolled, the advancing speed and the entering performance in the non-steady state are improved by the method of manufacturing a seamless pipe according to the embodiment.

Piercing and rolling is preferably carried out as the inclined roll interval in the piercing mill is set so that the set number of rotary forging represented by the following Expression (5) is not more than 1.5. In this way, the number of rotary forging after the billet 20 is caught between the inclined rolls 1 until the billet contacts the plug 2 can be reduced, so that inner surface defects at the tip end of the hollow shell can be reduced. Note that even if Expression (5) is not satisfied, the advantage of the invention can be obtained to some extent.

$$N=Ld/(0.5\times Vf\times\pi\times d/Vr) \quad (5)$$

where Ld is the distance (mm) from the position where the tip end of the billet 20 contacts the surface of the inclined rolls to the position where the tip end of the billet 20 reaches the tip end of the plug 2 in the direction of the pass line X-X, Vf is the speed (mm/s) of the billet 20 in the rotation direction and Vr is the speed of the billet 20 in the advancing direction (mm/s).

First Example

Piercing and rolling was carried out in various conditions where the thrust load acting on the plug was varied, and the incidence of inner surface defects at the tip end of a hollow shell was examined.

A solid round billet having an outer diameter of 70 mm was cut from a solid round billet produced by continuous casting, containing 0.2 mass % C (carbon) and having an outer diameter of 225 mm along its central axis. The obtained billet was heated to 1200° C. in a heating furnace.

The heated billet was formed into a hollow shell by piercing and rolling using the piercing mill shown in FIG. 2. More specifically, in conditions represented by test numbers in Table 1, 100 billets were pierced and rolled using the pusher for each of the test numbers. The plug load ratio in Table 1 was obtained by the following Expression (A):

Plug load ratio=thrust load PA (t) acting on the plug in a non-steady state/thrust load PB (t) acting on the plug in a steady state during piercing without using the plug (A)

In this example, the average thrust load acting on the plug in the non-steady state is represented as thrust load PA. Some of the billets were pierced and rolled without using the pusher in advance, and the average thrust load acting on the plug in the steady state is represented as thrust load PB.

The pusher pushing force (t) in Table 1 is set pusher force. The non-steady state speed (mm/s) is the average advancing speed of the billet in the non-steady state, and the steady state speed (mm/s) is the average advancing speed of the billet in the steady state without using the pusher.

The conditions other than those in Table 1 are as given in Table 2 and the same for all the test numbers. Note that as given in Table 2, Expressions (1) and (2) were satisfied in this example.

TABLE 1

| test No. | pusher pushing force (ton) | PA (ton) | PB (ton) | plug load ratio | set times of rotary forging (times) | advancing speed in non-steady state (mm/s) | advancing speed in steady state (mm/s) | incidence of inner surface defects (%) |
|---|---|---|---|---|---|---|---|---|
| 1 | 0.2 | 5.1 | 9.2 | 0.55 | 2.00 | 50 | 65 | 80 |
| 2 | 0.5 | 6.0 | 9.2 | 0.65 | 1.80 | 55 | 65 | 60 |
| 3 | 1.0 | 8.5 | 9.2 | 0.92 | 1.50 | 55 | 65 | 30 |
| 4 | 2.5 | 9.0 | 9.2 | 0.98 | 1.00 | 60 | 65 | 10 |
| 5 | 2.0 | 9.9 | 9.2 | 1.08 | 1.50 | 65 | 65 | 2 |
| 6 | 2.0 | 9.9 | 9.2 | 1.08 | 1.00 | 70 | 65 | 1 |
| 7 | 2.0 | 9.9 | 9.2 | 1.08 | 1.00 | 75 | 65 | 0 |
| 8 | 2.5 | 10.2 | 9.2 | 1.11 | 0.50 | 80 | 65 | 0 |
| 9 | 5.0 | 11.0 | 9.2 | 1.20 | 0.00 | 70 | 65 | 0 |

TABLE 2

| conditions | |
|---|---|
| Dg/d | 4.5 to 6.0 |
| EL | 2.5 |
| DFT | 0.87 |
| inclination angle (°) | 10 |
| crossed axes angle (°) | 20 |

The inner surface was visually examined in the range of 200 mm from the tip end of the produced hollow shell and examined for the presence/absence of inner surface defects. When at least one inner surface defect was present, it was determined that the billet was with an inner surface defect. For examination of the samples with test numbers, the inner surface defect incidence was obtained based on the following Expression (B):

Inner surface defect incidence=the number of billets with inner surface defects/the total number of billets (B)

where the total number of billets is the total number of billets pierced and rolled for each of the test numbers, which is 100 in this example as described above. In this example, it was evaluated that the inner surface defects were restrained when the inner surface defect incidence was less than 5%.

The obtained inner surface defect incidence is given in Table 1.

With reference to Table 1, samples with test Nos. 1 to 4 each had an advancing speed in the non-steady state that was less than the advancing speed in the steady state and outside the range defined by the invention. The plug load ratio was less than 1.0 that was outside the range defined by the invention. Therefore, the inner surface defect incidence was more than 5%.

In contrast, samples with test Nos. 5 to 9 each had a plug load not less than 1.0 and their advancing speeds in the non-steady state were not less than their advancing speeds in the steady state. Therefore, the inner surface defect incidences were significantly lower than those of the samples with test Nos. 1 to 4. Note that when the plug load ratio was raised to 1.08 or higher and the set rotary forging number was not more than 1.0, the inner surface defect incidence was 0%.

Example 2

Piercing and rolling was carried out while the plug load ratio was kept constant and the gorge draft ratio DFT and the piercing and rolling ratio EL were varied, and it was examined whether the billet in the process of piercing and rolling slipped.

A solid round billet was prepared, its kind of steel was defined as S45C by JIS standards, and its outer diameter was 70 mm. The prepared solid round billet was heated to 1200° C. in a heating furnace, then pierced and rolled using the piercing mill shown in FIG. 2 and formed into a hollow shell. At the time, the gorge draft ratio DFT and the piercing and rolling ratio EL were varied for each billet. The conditions other than the gorge draft ratio DFT and the piercing and rolling ratio EL were as given in Table 3 for any of the billets. As given in Table 3, the plug load ratio was 1.20 and the billet advancing speed in the non-steady state was not less than the billet advancing speed in the steady state without using the pusher.

During the piercing and rolling, each billet was pushed by the pusher, caught between the inclined rolls and continued to be pushed until the piercing and rolling reached a steady state. After the billet was pushed for 300 mm from the position where the billet was caught, the operation of the pusher was stopped.

TABLE 3

| conditions | |
|---|---|
| Dg/d | 5.8 |
| PA | 11.0 |
| PB | 9.2 |
| plug load ratio | 1.20 |
| inclination angle (°) | 10 |
| crossed axes angle (°) | 20 |

After the pusher was stopped, it was examined whether slipping was caused during the piercing and rolling. If the billet stopped advancing while it was pierced and rolled or while the rear end of the billet was pierced and rolled (so-called tailing-off failure), it was determined that misroll was caused by slipping.

Figure 6:
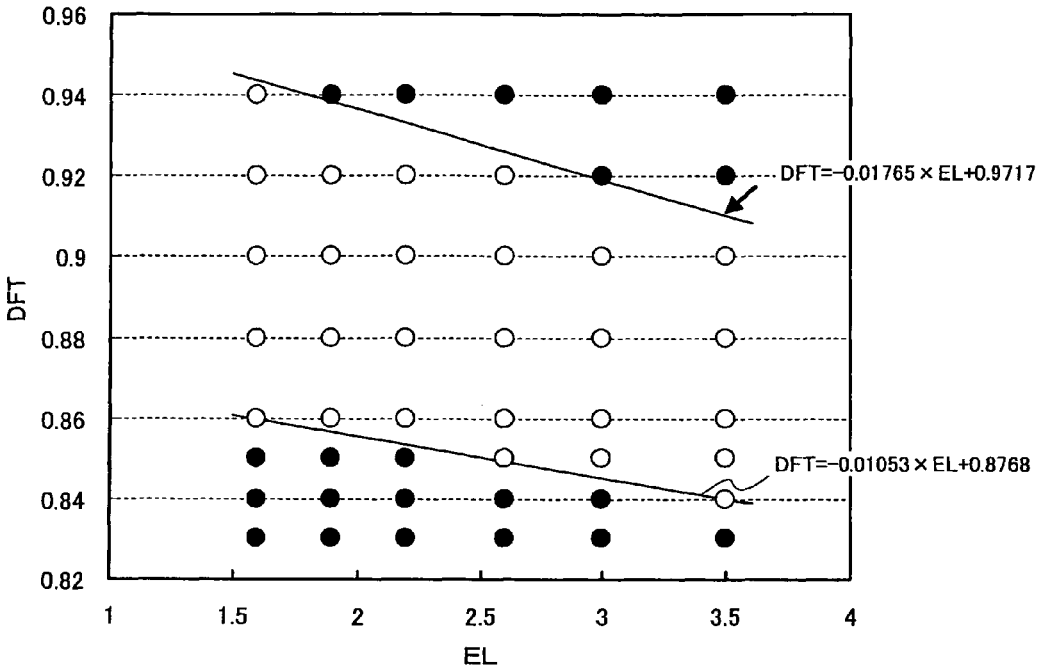
FIG. 6 is a graph showing the relation between the gorge draft ratio and the piercing and rolling ratio measured in Example 2.

The examination result is given in FIG. 6. The abscissa in FIG. 6 represents the piercing and rolling ratio EL, and the ordinate represents the gorge draft ratio DFT. In FIG. 6, "○" indicates that stable piercing and rolling was carried out without misroll caused by slipping, while "●" indicates that misroll was caused by increased slipping in piercing and rolling.

With reference to FIG. 6, when the gorge draft ratio DFT and the piercing and rolling ratio EL satisfied Expression (2), no misroll was caused. Meanwhile, when the gorge draft ratio DFT and the piercing and rolling ratio EL did not satisfy Expression (2), misroll was caused.

Although the embodiments of the present invention have been described, they are by way of illustration and example only and are not to be taken by way of limitation. The invention may be embodied in various modified forms without departing from the spirit and scope of the invention.

INDUSTRIAL APPLICABILITY

The method of manufacturing a seamless pipe or tube according to the invention is applicable to a method of manufacturing a seamless pipe or tube by piercing and rolling a material into a hollow shell using a piercing mill.

What is claimed is:

1. A method of manufacturing a seamless pipe or tube by piercing and rolling a billet using a piercing mill comprising a pusher provided on an inlet side along a pass line, a plug provided on an outlet side along the pass line, and a plurality of inclined rolls provided opposed to one another with the plug therebetween, said method comprising the steps of:

placing said billet on the pass line between said pusher and said plug;

advancing said billet to be caught between said plurality of inclined rolls; and pushing said billet forward by said pusher so that at least between when said caught billet contacts said plug and when the piercing and rolling reaches a steady state, a advancing speed of said billet is at least equal to the advancing speed of said billet when the piercing and rolling is carried out without pushing said billet forward by said pusher in the steady state, and further comprising the step of setting the position of said inclined rolls before the piercing and rolling so that Expressions (1) and (2) are satisfied, $$Dg/d \geqq 4.5 \quad (1)$$

$$-0.01053EL+0.8768 \leqq DFT \leqq -0.01765EL+0.9717 \quad (2)$$

where Dg is a roll diameter (mm) of a gorge part of said inclined roll, d is a outer diameter (mm) of said billet, DFT is a gorge draft ratio, and EL is a piercing and roiling ratio in Expression (2), and said ratios are defined by Expressions (3) and (4):

$$DFT=Rg/d \quad (3)$$

$$EL=L1/L0 \quad (4)$$

where Rg is a roll interval (mm) that is minimized at the gorge part, L0 is a length (mm) of said billet, and L1 is a length (mm) of a hollow shell after piercing.

2. The method of manufacturing a seamless pipe or tube according to claim 1, wherein said step of pushing forward comprises the step of pushing said billet forward by said pusher so that at least between when said caught billet contacts said plug and when the piercing and rolling reaches the steady state, thrust load acting on said plug is at least equal to thrust load acting on said plug when piercing and rolling is carried out without pushing said billet forward by said pusher in the steady state.

3. The method of manufacturing a seamless pipe or tube according to claim 1, further comprising the step of stopping pushing said billet forward by said pusher when the piercing and rolling reaches the steady state.

4. The method of manufacturing a seamless pipe or tube according to claim 3, wherein said piercing mill further comprises a detector provided on said outlet side to detect whether a tip end of a hollow shell passes between a rear ends of said inclined rolls, and in said stopping step, said pushing forward of said billet by said pusher is stopped when said detector detects the tip end of the hollow shell passing between the rear ends of said inclined rolls.

* * * * *